US005702540A

United States Patent [19]

Kubota

[11] Patent Number: 5,702,540

[45] Date of Patent: Dec. 30, 1997

[54] VACUUM CARBURIZING METHOD AND DEVICE, AND CARBURIZED PRODUCTS

[75] Inventor: Ken Kubota, Aichi-ken, Japan

[73] Assignee: JH Corporation, Japan

[21] Appl. No.: 623,129

[22] Filed: Mar. 28, 1996

[30] Foreign Application Priority Data

Mar. 29, 1995 [JP] Japan ..... 7-072043

[51] Int. Cl.[6] ..... C21D 1/06; C23C 8/22

[52] U.S. Cl. ..... 148/223; 148/235; 148/218; 148/319

[58] Field of Search ..... 148/223, 235, 148/225, 218, 319; 266/257, 252

[56] References Cited

U.S. PATENT DOCUMENTS 4,035,203 7/1977 L'Hermite et al. .
4,108,693 8/1978 L'Hermite et al. .
5,139,584 8/1992 Gantois .
5,205,873 4/1993 Faure et al. ..... 148/206
5,366,205 11/1994 Gantois .

FOREIGN PATENT DOCUMENTS 50-96410 7/1975 Japan .
3215657 9/1991 Japan .

*Primary Examiner*—Deborah Yee
*Attorney, Agent, or Firm*—Sixbey, Friedman, Leedom & Ferguson, P.C.; Gerald J. Ferguson, Jr.; Joan K. Lawrence

[57] ABSTRACT

In order to keep down soot production and to enable every part of the workpiece, including deep concavities to be uniformly carburized by vacuum carburizing, and to enable decreases in the quantities of gas and heat employed, carburizing treatment is performed in the heating chamber 2 of a vacuum carburizing furnace 1 with workpieces M being heated while acetylene gas is supplied from a carburizing gas source C inside the heating chamber 2, and the inside of the heating chamber 2 being evacuated by a vacuum evacuation source V to give a vacuum of ≦1 kPa.

8 Claims, 5 Drawing Sheets

VACUUM CARBURIZING METHOD AND DEVICE, AND CARBURIZED PRODUCTS

FIELD OF THE INVENTION

The present invention relates to a vacuum carburizing method, a vacuum carburizing device for carrying out this method, and carburized steel products.

DESCRIPTION OF THE PRIOR ART

The carburizing treatment most widely employed as a method for surface improvement of iron and steel is generally gas carburizing in a gaseous atmosphere; however, gas carburizing has the problems of producing an abnormal surface layer, having inadequate furnace structure for high-temperature carburization, producing soot, and having many carburizing conditions which are complicated to control, etc., and vacuum carburizing methods using a vacuum carburizing furnace have been disclosed in order to overcome these problems.

In prior vacuum carburizing methods a gaseous saturated aliphatic hydrocarbon is used as the carburizing gas. Thus, methane type gases such as methane gas ($CH_4$), propane gas ($C_3H_8$) and butane gas ($C_4H_{10}$) have been employed as gaseous saturated aliphatic hydrocarbons; these carburizing gases are supplied directly to the heating chamber of a vacuum carburizing furnace in which workpieces comprising steel material are heated to about 900°–1000° C., and it is thermolysed in the heating chamber and the activated carbon produced in this process penetrates into the surface of the steel material, so as to cause carburizing and dispersion from the surface thereof.

In order to supply the carburizing gas fully to the surface of the work in this case it is necessary that the carburizing gas permeates the total surface of the workpieces, and therefore the heating chamber holding the workpieces is held at a vacuum, and the pressure of the furnace is varied by stirring the carburizing gas above as it is supplied, or by pulsed admission.

In this connection, the perception in prior method of vacuum carburizing is that a hydrocarbon should generally be employed as the carburizing gas in order to give strong carburizing, and of the hydrocarbons, gaseous saturated aliphatic hydrocarbons Such as methane type gases such as those above are employed.

The reason is that it is perceived among those skilled in the art that methane type gases are stable in the temperature range up to about 1100° C. at which steel materials are carburized, and carburizing power becomes stronger as molecular weight increases although stability decreases and soot is produced, whereas it is perceived gaseous unsaturated aliphatic hydrocarbons such as acetylenic gases are more unstable than methane type gases and thermolysis proceeds better than carburizing so that when used as carburizing gases they simply produce soot, and are not at all suitable as carburizing gases (see Kawakami & Gosha "*Kinzoku hyomen koka shori gijutsu*" [*Metal surface hardening treatments*" Miki Shoten (25 Oct. 1971) p. 139).

Consequently, in practice only gaseous saturated aliphatic hydrocarbon methane type gases such as methane gas ($CH_4$), propane gas ($C3_3H_8$) and butane gas ($C_4H_{10}$) are employed as carburizing gases, and gaseous unsaturated hydrocarbon acetylene type gases have been ignored.

However, although the conventional vacuum carburizing method has solved the quality problems with gas carburizing, it still involves the problems listed below.

These include the following.

1. A lot of soot is produced, making the operation of maintenance complicated and dirty.
2. Uniform carburizing is difficult without decreasing the quantity of workpieces inserted into the heating chamber and increasing the quantity of gas.
3. It is inadequate for carburizing small diameter holes and narrow crevices in workpieces.
4. Equipment costs are high, and it is restricted to special uses.
5. Productivity is low and treatment costs are high compared with gas carburation.

The mechanism of thermolysis of prior carburizing gas is shown by the equations below.

$$C_3H_8 \rightarrow [C] + C_2H_6 + H_2$$

$$C_2H_6 \rightarrow [C] + CH_4 + H_2$$

$$CH_4 \rightarrow [C] + 2H_2$$

In the equations above, [C] is the activated carbon that contributes to carburizing. Activated carbon from decomposition in the space inside the furnace other than the surface of the work simply becomes soot, and this is the cause of soot production in vacuum carburizing.

Measures in order to decrease the production of this soot include the following.

a. Using the carburizing gas diluted with an inert gas (gas pressure as in the prior method) in order to make the quantity of carburizing gas in the furnace as dilute as possible.
b. Mixing an oxygen source (e.g. an alcohol) with the carburizing gas to an extent which will not produce an abnormal layer, so that part of the activated carbon is employed for carburizing as CO and excess CO gas is expelled from the furnace.
c. A measure which has benefits other than countering soot involves generating a plasma near the work surface to ionize the dilute carburizing gas and effectively employ attraction to the work surface, so that little soot is generated by decomposition in the rest of the furnace space (plasma carburizing).

All of these countermeasures can decrease the quantity of soot generated, but they have the problem that due to this equipment and treatment costs are raised and the original merits of vacuum carburizing are lost.

Also, when it comes to trying to get uniform carburizing it is impossible to avoid variation in carburized case depth with vacuum carburizing using a methane type gas as the carburizing gas when the gap between loaded workpieces is inadequate or when the workpieces have small diameter holes or narrow crevices because adequate carburized case depth is not obtained deep inside holes or the crevices or when neighbouring pieces are too close together. For example, when carburizing treatment was performed within a furnace in a heating chamber fitted with a gas circulation device, gas mixing device or high-speed gas spraying device, when holes 4 mm in diameter and 28 mm deep were opened in the workpieces the effective carburized case depth at the bottom of the holes was about 0.30 mm as opposed to about 0.51 mm in the outside surface of the work.

It is suggested that this variation in carburized case depth occurs because the number of hydrogen atoms is large relative to the number of carbon atoms, and on decomposition in the heating chamber to produce atomic carbon there are more hydrogen molecules in the gas produced by decomposition and this decreases the mean free path of carburizing molecules.

In order therefore to perform carburizing treatment so that the desired carburized case depth can be ensured on the inner wall surface of small diameter holes, carburizing treatment is performed by supplying carbon into holes, or by supplying more carburizing gas than is necessary and flow mixing of the gas, and this results in an increase in the quantity of soot generated.

SUMMARY OF THE INVENTION

The present invention is a response to problems such as those described above, and its aim is to offer a vacuum carburizing method and device, and carburized steel products, which keep down the production of soot, enable uniform carburizing of the whole surface of work pieces including the inner walls of deep concavities, and save on the quantity of gas and the quantity of heat employed.

A vacuum carburizing method according to the present invention is a method in which carburizing treatment is performed by vacuum heating of workpieces from a steel material in the heating chamber of a vacuum carburizing furnace, and supplying a carburizing gas into the heating chamber, characterized in that a gaseous unsaturated aliphatic hydrocarbon is employed as the carburizing gas, and that carburizing treatment is performed with the heating chamber at a vacuum of $\leqq 1$ kPa.

The use of an acetylenic gas, and especially acetylene gas, as the gaseous unsaturated hydrocarbon above is desirable.

Moreover, a vacuum carburizing method according to the present invention can be applied to carbonitriding treatment in which nitrogen (N) is penetrated into the surface of the steel material at the same time as carbon (C), as well as to simple vacuum carburizing. In this case, ammonia gas ($NH_3$) for example can be added as a gaseous nitrogen source in addition to acetylene gas as a carburizing gas.

Similarly, a vacuum carburizing device according to the present invention is provided with a vacuum carburizing chamber provided with a heating chamber for heating workpieces from a steel material, and a carburizing gas source which supplies an acetylenic gas into the heating chamber above, and a vacuum evacuation source which evacuates the heating chamber, characterized in that vacuum carburizing is performed at $\leqq 1$ kPa.

Moreover, steel products carburized by the present invention are steel products provided with closed holes with an inner diameter D in which the inner wall of the closed holes are carburized, characterized in that the region over which carburized case depth in the inner wall surface of the closed holes above is virtually uniform extends to the depth L from the open end of the holes where the depth L is in the range 12 to 50.

In order to achieve vacuum carburizing (decreased pressure gas carburizing) without soot it is desirable that there is no decomposition in the furnace other than for the carbon which contributes directly to carburizing, and therefore it is desirable that in as far as possible the carbon source supplied into the furnace is decomposed or reacted only at the surface of the workpiece, and not otherwise decomposed or reacted on the furnace material or in the furnace space.

From the point of view of this condition it is desirable that the carburizing gas is a chemically unstable active gas rather than the type of stable methane type gas employed as carburizing gas in the prior vacuum carburizing method.

Accordingly, in the vacuum carburizing method according to the present invention an unsaturated aliphatic hydrocarbon gas which is more chemically active and reacts and decomposes more readily than saturated aliphatic hydrocarbon gases such as methane gas or propane gas, etc., is employed as the carburizing gas.

However, with these unstable gases soot is produced more easily by thermolysis than in the case of saturated hydrocarbons employed in the prior art when the dwell time in the furnace exceeds a limit, and therefore the time the gas stays inside the furnace needs to be strictly limited, and it needs to be expelled outside the furnace in a time within a range adequate for reaction and decomposition at the workpiece surface but inadequate for thermolysis.

Consequently, in the vacuum carburizing method according to the present invention the vacuum carburizing method is realized with an extremely low pressure inside the furnace compared with the prior vacuum carburizing method, at 1 kPa, in order to shorten the time that the carburizing gas stays inside the furnace so that the decomposition reaction occurs at the workpiece surface and hardly any soot is produced in the space inside the furnace.

Similarly, in order to move the composite gas produced after supplying the carbon decomposed at the surface of the workpiece and distribute newly supplied gas, in the prior vacuum carburizing method the gas pressure is made somewhat high (15–70 kPa) and the composite gas is decreased by decreasing the pressure using mixing within the furnace such as a fan or by pulsing the input of gas, and new high pressure gas is admitted in pulses to ensure the quantity of carbon supplied to the workpiece surface. Naturally, this means that much more carburizing gas is supplied than is needed for carburizing, and this helps to produce more soot.

By contrast, in the vacuum carburizing method according to the present invention a gaseous unsaturated aliphatic hydrocarbon is employed as the carburizing gas, and ethylene gas ($C_2H_4$) or acetylene gas ($C_2H_2$) which are gaseous unsaturated aliphatic hydrocarbons differ from the methane type gases previously employed in that the number of hydrogen atoms is smaller compared with the number of carbon atoms.

For this reason, when the carburizing gas decomposes in the heating chamber to produce atomic carbon, not many molecules of decomposition gases such as hydrogen gas, etc., are produced, and therefore the number of hydrogen gas molecules that can hinder contact of carburizing gas molecules with the workpiece can be decreased. As a result, since the pressure during carburizing treatment is low and the mean free path of the carburizing gas molecules is extended, it becomes easy for the molecules of carburizing gas to penetrate into the inner walls around deep concavities in the workpiece; since moreover, the carburizing gas molecules are chemically active and they are of a readily decomposed unsaturated hydrocarbon, they react readily with the workpiece surface in a short time even when not subjected to high temperature and not for a long time, and together with the fact that atomic carbon from deposition can be supplied to the workpiece surface this means that every part of the workpiece can be uniformly carburized.

The uniformity of this carburizing is better the lower the pressure in the furnace. In this connection, in workpieces provided with closed holes of inner diameter D, when carburizing treatment is performed with a pressure inside the furnace of 0.02 kPa a depth L of a region in which total carburized case depth is almost uniform is achieved up to an L/D ratio of 36. If the pressure inside the furnace is made even lower a depth L of the region in which the total carburizing depth is almost uniform will be achieved up to an L/D of 50. Such a figure cannot of course be achieved with prior gas carburizing, or with vacuum carburizing or plasma carburizing.

In the present invention carburizing treatment is performed at ≦1 kPa, which is extremely low compared with prior vacuum carburizing, and therefore the time from being supplied to the heating chamber to being withdrawn by the suction means for maintaining low pressure, i.e. the dwell time of the gas in the heating chamber, becomes short. Because the dwell time is short the carburizing gas which is not decomposed in that time can be removed from the heating chamber before it can be decomposed in the heating chamber and produce soot, and the production of soot in the heating chamber can be prevented.

Consequently, although a gaseous unsaturated hydrocarbon which is unstable and decomposes readily is employed as the carburizing gas, it becomes possible to carburize workpieces while preventing soot production without hindering carburizing because the necessary quantity of carburizing gas can be decomposed by contact with the surface of the workpiece within the short time to bring about carburizing, while the non-decomposed carburizing gas prone to produce soot is expelled directly from the heating chamber together with the gas produced after decomposition (hydrogen gas, etc.). The fact that gas produced by decomposition is also expelled from the heating chamber within a short time can also contribute to further extending the mean free path of the carburizing gas molecules, and contribute to the uniform carburizing of every part of the workpiece.

Moreover, by determining the quantity of carburizing gas expelled by the evacuation pump it is possible to regulate properly the quantity of carburizing gas admitted to the heating chamber and thereby to keep the quantity of carburizing gas employed to a minimum.

Also, because a chemically active gaseous unsaturated aliphatic hydrocarbon which readily reacts and decomposes is employed as the carburizing gas in the vacuum carburizing method according to the present invention, the gas can react readily with the workpiece surface and decompose to bring about carburizing without supplying more carburizing gas than is necessary as in the case of prior methane gases, so that the quantity of gas supplied can be kept down to a number of carbon atoms within about twice the total quantity of carbon necessary for carburizing the surface of the workpieces. In this connection, a quantity of carburizing carbon of the order of several tens of times that necessary is supplied to the furnace in prior vacuum carburizing. Moreover, in the vacuum carburizing method according to the present invention carburizing is performed at a low pressure of ≦1 kPa so that the heating chamber itself manifests an adiabatic effect relative to the outside of the heating chamber, so that there is little radiant heat loss and the quantity of heat required to maintain the temperature inside the heating chamber can be decreased.

Therefore, the vacuum carburizing method of the present invention gives considerable benefits in that soot production can be kept down compared with prior vacuum carburizing methods despite daring to employ as carburizing gas gaseous unsaturated aliphatic hydrocarbons, which have been ignored in the prior art as merely being prone to produce soot, every part of the workpiece including the inner wall surface of deep concavities can be evenly carburized, and the quantity of gas and heat employed can be decreased.

Moreover, with the vacuum carburizing method according to the present invention the heating chamber manifests an adiabatic effect relative to the outside of the chamber because the inside of the heating chamber is held at a low pressure of ≦1 kPa; therefore the need for water cooling or heat insulation of the vacuum chamber itself is decreased, and consequently the structure of the outer wall of the vacuum vessel including the heating chamber needs only consider the maintenance of low pressure and does not need to have a special insulating structure, and this can contribute towards decreasing the number of manufacturing processes and the cost of manufacture.

In passing, ion carburizing and plasma carburizing are known methods for low-pressure carburizing of workpieces, but with these carburizing methods the production of carburizing variation is unavoidable when the workpiece has deep concavities because ionized gas cannot reach the bottom of concavities, and although less soot is produced than with prior vacuum carburizing methods the production of soot cannot be kept down as in the vacuum carburizing method of the present invention; moreover, they have the drawback that equipment costs are high.

When acetylene gas is employed as the ethylenic gas or acetylenic gas used as a gaseous unsaturated aliphatic hydrocarbon there are fewer component hydrogen atoms than in the case of ethylene gas, it is more active and performs carburizing treatment more easily, the quantity employed can be decreased, and treatment costs can be decreased.

Moreover, by performing carbonitriding treatment by adding ammonia ($NH_3$) for example as a gaseous nitrogen source in addition to acetylene gas as a carburizing gas, it becomes possible to quench at a lower temperature, and distortion is decreased.

DESCRIPTION OF PREFERRED EMBODIMENTS

The form of embodiments of the present invention is explained below on the basis of the diagrams.

Figure 1:
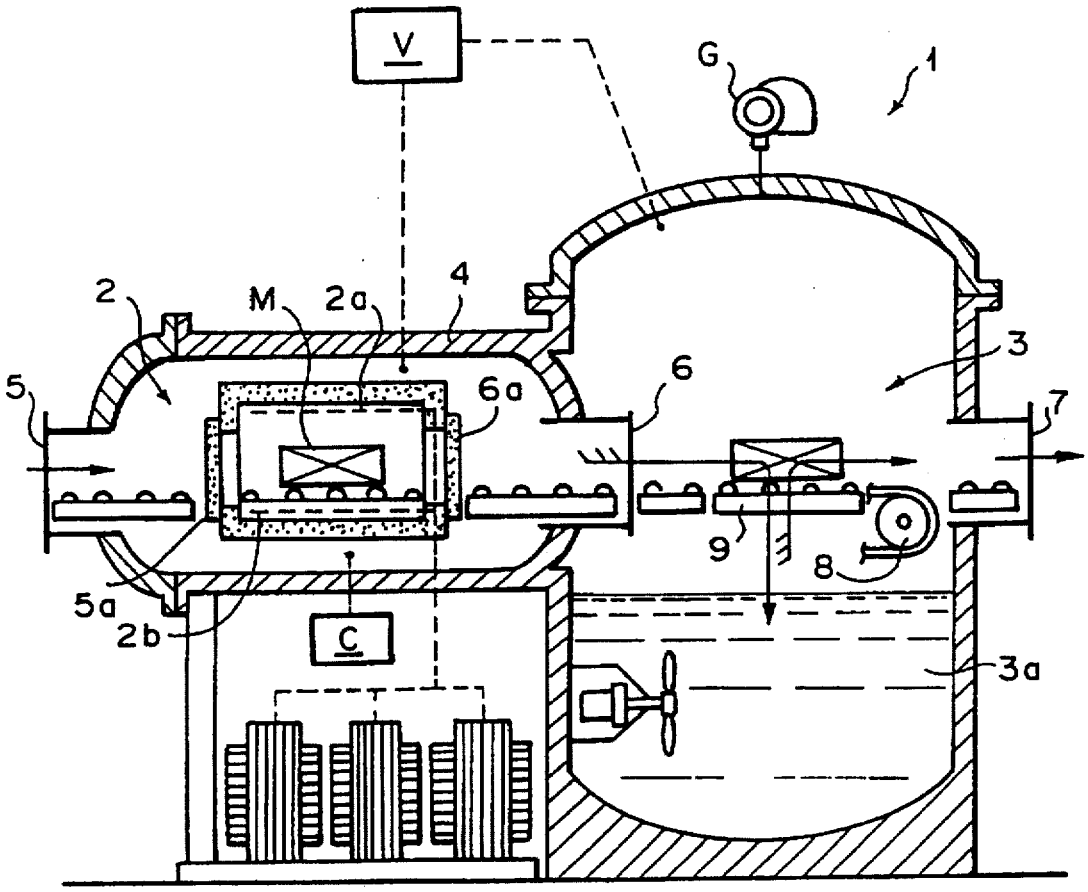
FIG. 1 is a cross-sectional diagram showing the form of 1 embodiment of a vacuum carburizing device according to the present invention.

FIG. 1 is a diagram showing the form of one embodiment of a vacuum carburizing device according to the present invention: a vacuum carburizing furnace 1 is provided with a heating chamber 2 covered by a vacuum vessel 4, and a cooling chamber 3 adjoining this heating chamber 2.

The heating chamber 2 is constituted from a heat-generating element **2*a* which is chemically and mechanically stable in a high temperature vacuum environment and in the atmosphere, and a heat-insulating material 2*b*. As the heat-generating element 2*a*** a heat-generating element of silicon carbide subjected to recrystallization treatment or such an element with an alumina spray coated layer formed on the surface thereof can be employed. As the heat-insulating material 2b highly pure ceramic fibres can be employed. The outer wall of the cooling chamber 3 is constituted by part of the vacuum vessel 4, and it is provided with an oil tank 3a.

A vacuum evacuation source V is connected to both the heating chamber 2 and the cooling chamber 3; the heating chamber 2 is also connected to a carburizing gas source C of acetylene gas dissolved in acetone which can supply acetylene gas, and the cooling chamber 3 is connected to an inert gas source G of nitrogen gas, etc., which can be pressurized to atmospheric pressure or above.

At the upstream end of the heating chamber 2 there is an entry door 5 and at the downstream end there is a middle door 6, and at the downstree end of the cooling chamber 3 there is an exit door 7; and there is an internal conveying device 8 which conveys workpieces M from the upstream end of the heating chamber 2 to the downstream end of the cooling chamber 3. In the cooling chamber 3 there is a vertically travelling platform 9 for putting the workpiece M into the oil tank 3a and taking it out. Moreover, in the heating chamber 2 there are heating parts in the inner entry door and 5a and inner middle door 6a the ends of which are closed.

Figure 2:
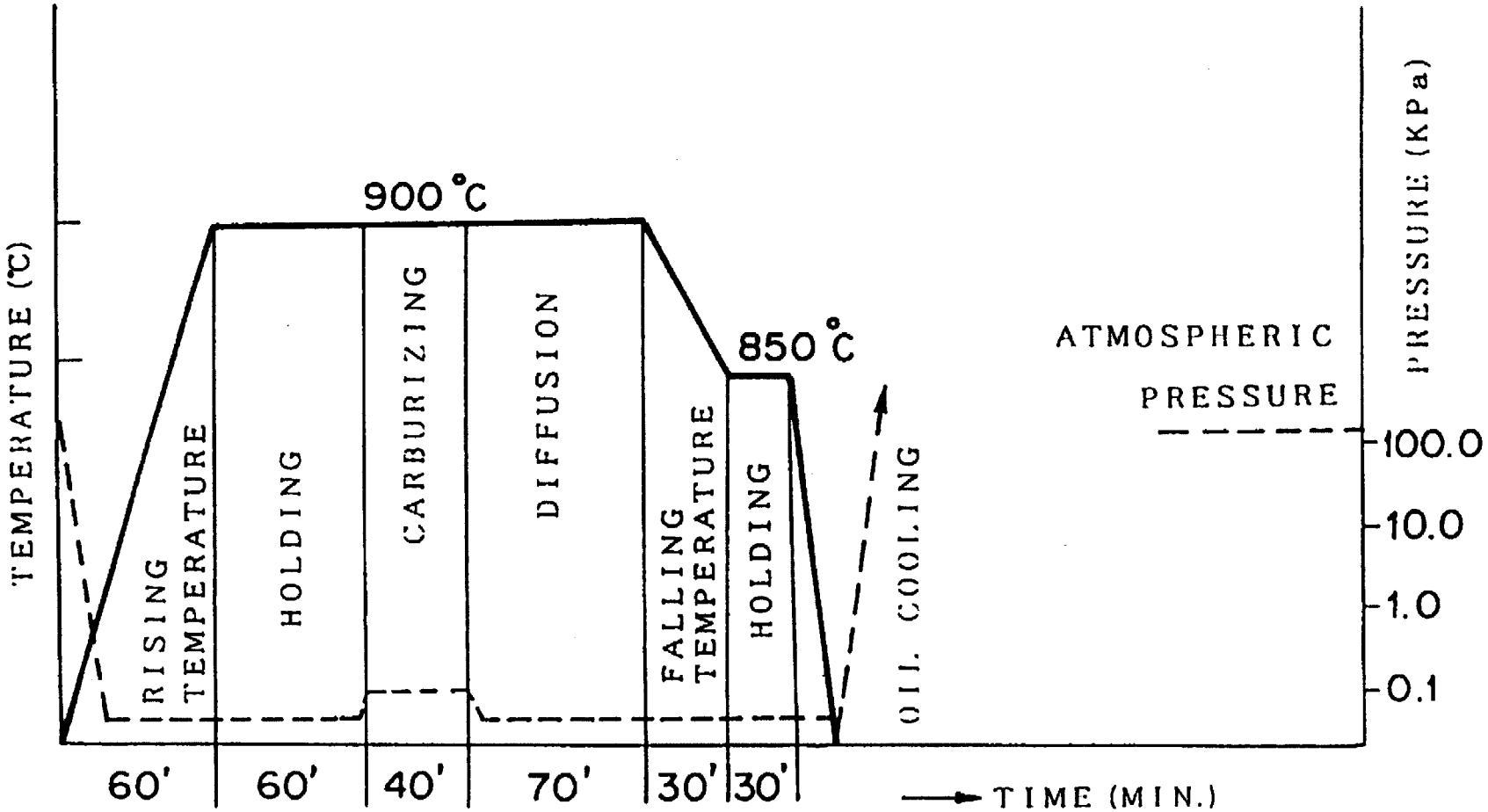
FIG. 2 is a diagram showing the operating pattern of a vacuum carburizing furnace according to the present invention.

The method for vacuum carburizing employing a vacuum carburizing device constituted in this manner is next explained with reference to FIG. 2. The heating chamber 2 is preheated to the desired temperature at atmospheric pressure.

Process 1

The entry doors 5, 5a are opened and a 1st workpiece M1 is conveyed into the heating chamber 2, after which the entry doors 5, 5a are immediately closed.

Process 2

The heating chamber 2 is evacuated to a vacuum of 0.05 kPa by the vacuum evacuation source V while the 1st workpiece M1 is vacuum heated to the desired temperature (900° C.), after which acetylene gas from the carburizing gas source C is supplied into the heating chamber 2 (at this time the pressure inside the heating chamber 2 becomes 0.1 kPa), and carburizing is performed. The supply of acetylene gas is stopped, diffusion is performed with the vacuum inside the heating chamber 2 again at 0.05 kPa, and soaking heat treatment is performed with the temperature falling to the quenching temperature of 850° C. Meanwhile, the cooling chamber 3 is evacuated.

Process 3

The middle doors 6, 6a are opened, the 1st workpiece M1 is moved by the internal conveying device 8 onto the vertically travelling platform 9 of the cooling chamber 3, and then the middle doors 6, 6a are immediately closed.

Process 4

The cooling chamber 3 is pressurized to atmospheric pressure or above by supplying an inert gas from the inert gas source G, as the vertically travelling platform 9 is lowered to quench the 1st workpiece Mi. During this process, air is introduced into the high-temperature heating chamber 2 to bring it to atmospheric pressure, and then the entry doors 5, 5a are opened, a 2nd workpiece M2 is carried into the heating chamber 2, and then the entry doors 5, 5a are immediately closed. In passing, the reason for pressurizing the cooling chamber to atmospheric pressure or above is to prevent the air introduced into the heating chamber 2 from entering the cooling chamber 3.

Process 5

The vertically travelling platform 9 is raised, the exit door 7 is opened, the 1st workpiece M1 is immediately conveyed outside the furnace 1, the exit door 7 is immediately closed, and the cooling chamber 3 is vacuum cooled. Meanwhile the 2nd workpiece M2 is handled as in Process 2.

Thereafter carburizing of successive workpieces is ordinarily performed by repeating Processes 3–5.

Figure 3:
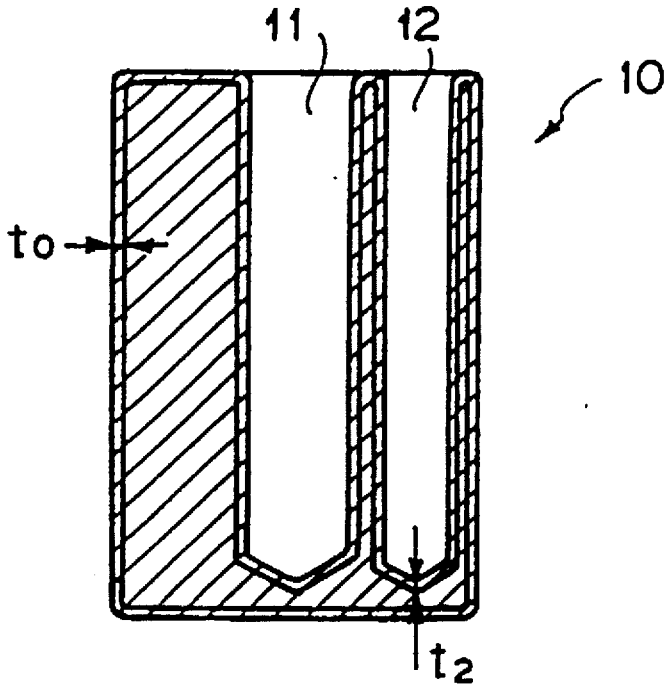
FIG. 3 is a cross-sectional diagram of a sample carburized by the vacuum carburizing method of the present invention.

FIG. 3 shows a cross-sectional diagram of an example of a workpiece carburized in this way: sample workpieces 10 of outer diameter 20 mm and length 30 mm provided with closed holes 11 of inner diameter 6 mm and depth 28 mm and closed holes 12 of inner diameter 4 mm and depth 28 mm were placed 300 at a time on palettes 400 mm wide, 600 mm long and 50 mm high and 6 of these palettes were placed one on top of the other in the heating chamber 2, and when treated at a carburizing temperature of 900° C., with a carburizing time of 40 minutes, a diffusion time of 70 minutes and a quenching temperature of 850° C. the effective carburized case depth $t_0$ of each workpiece was about 0.51 mm, and the effective carburized case depth $t_2$ at the bottom of the small-diameter holes 12 was about 0.49 mm. Thus, it was demonstrated that with the vacuum carburizing method of this embodiment carburizing treatment of every part could be performed evenly with a variation of about 0,02 mm.

Moreover, no accumulation of soot was noticeable in the heating chamber 2 even after repeating the experiment several hundred times. Similarly, when closed holes 4 mm in inner diameter and 50 mm deep were put in samples almost twice as long as the sample 10 above and they were carburized in the same way the difference between effective carburized case depth in the outer surface and effective carburized case depth at the bottom of the holes could be kept down to about 0.03 mm, showing that with the vacuum carburizing method of this embodiment it is possible to perform uniform carburizing of every part.

In this connection, when workpiece samples 10 were carburized by a prior vacuum carburizing method using a prior methane type gas as the carburizing gas, carburizing variability was produced despite carburizing for about twice the time and supplying ≧10 times as much carburizing gas into the heating chamber 2, with the effective carburized case depth in the outer surface of the workpiece samples 10 being 0.51 mm and the effective carburized case depth of the bottom of holes 12 with an inner diameter of 4 mm being 0.30 mm. Moreover, with the prior vacuum carburizing method there was burn-out when carburizing was repeated 5–20 times, a large quantity of soot accumulated inside the heating chamber 2 and cleaning was necessary. With the gas carburizing generally carried out it could not be expected that carburizing would reach the bottom of holes 12.

In passing, by performing carburizing with a vacuum of ≦1 kPa inside the heating chamber in the vacuum carburizing method of the present invention it is possible to avoid variability in carburizing workpieces even though acetylene gas is employed as the carburizing gas, and carburizing can be performed while keeping down soot production; however, performing carburizing treatment with a pressure inside the heating chamber which exceeds 1 kPa is undesirable; it becomes difficult to keep down soot production, and carburizing also becomes uneven.

By further lowering the pressure inside the heating chamber it is possible to increase the benefits of the methods of the present invention, and the adiabatic effect of the heating chamber itself can also be manifested more effectively so that water-cooling or insulation, etc., becomes unnecessary and the energy saving benefits can be heightened, so that from this point of view it is desirable that carburizing treatment is performed with the pressure inside the heating chamber preferably decreased to ≦0.3 kPa, and more preferably to ≦0.1 kPa.

Figure 4:
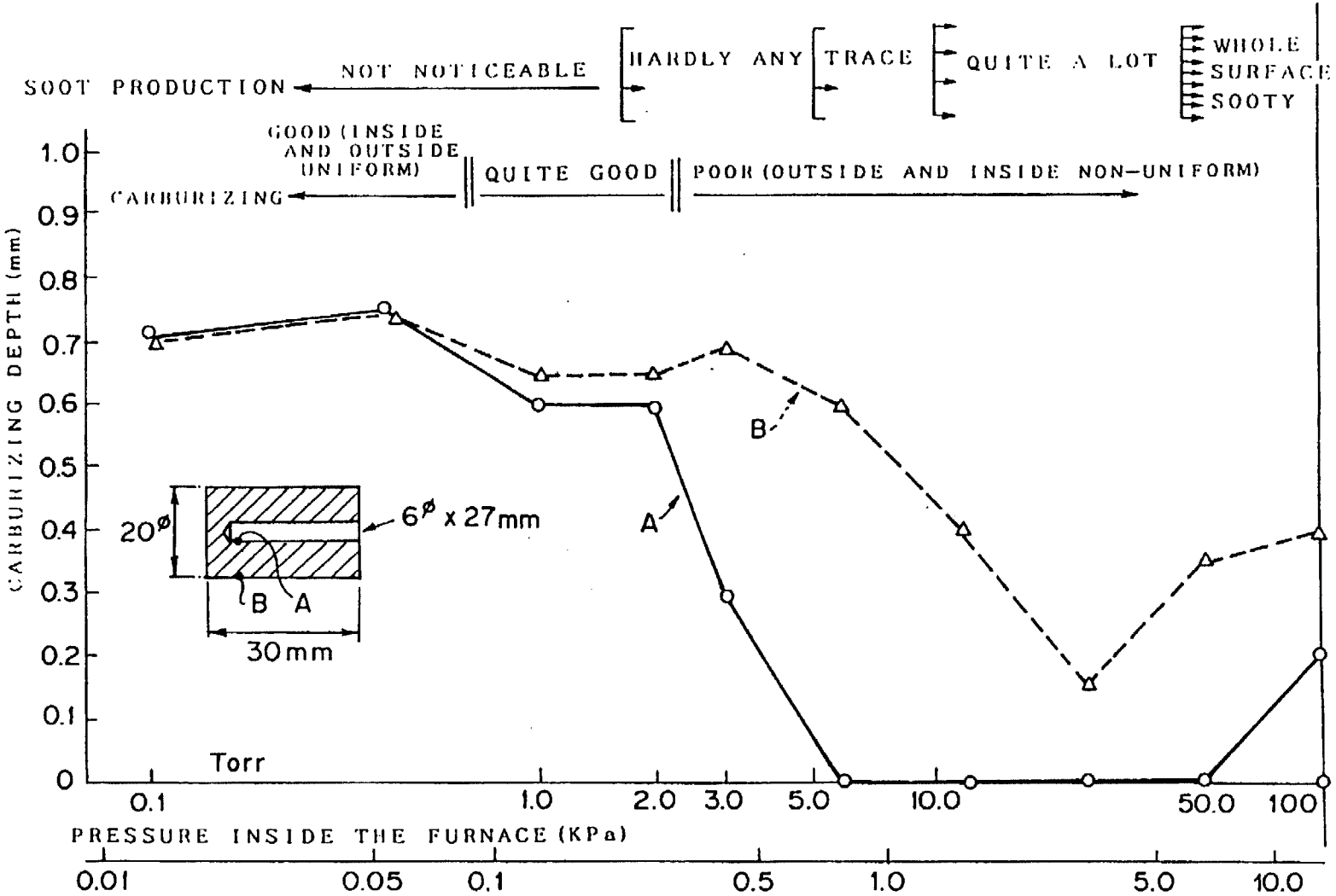
FIG. 4 is graphs showing the relationship between carburized case depth and the pressure inside the furnace when carrying out the vacuum carburizing method of the present invention, and the production of soot.

FIG. 4 is graphs showing the relationship between carburized case depth and pressure inside the furnace, and soot production, when carburizing treatment at a temperature of 930° C. was carried out on samples (SCM415) 20 mm in diameter and 30 mm long provided with closed holes 6 mm in diameter and 27 mm deep, using acetylene gas with a holding time, carburizing time and diffusion time (see FIG. 2) of 30 minutes, 30 minutes and 45 minutes respectively. Line A represents the changes in carburized case depth at the bottom of the closed holes, and line B shows changes in carburized case depth in the surface of the workpiece sample.

It is clear from FIG. 4 that in relation to the surface of the sample a nearly constant carburized case depth is obtained when the pressure inside the furnace is ≦1.0 kPa. However, in order to carburize the inside and outside of closed holes uniformly it is desirable that the pressure inside the furnace be ≦0.3 kPa.

Looking at soot production: there is no problem provided that the pressure inside the furnace is ≦1.0 kPa.

Figure 5:
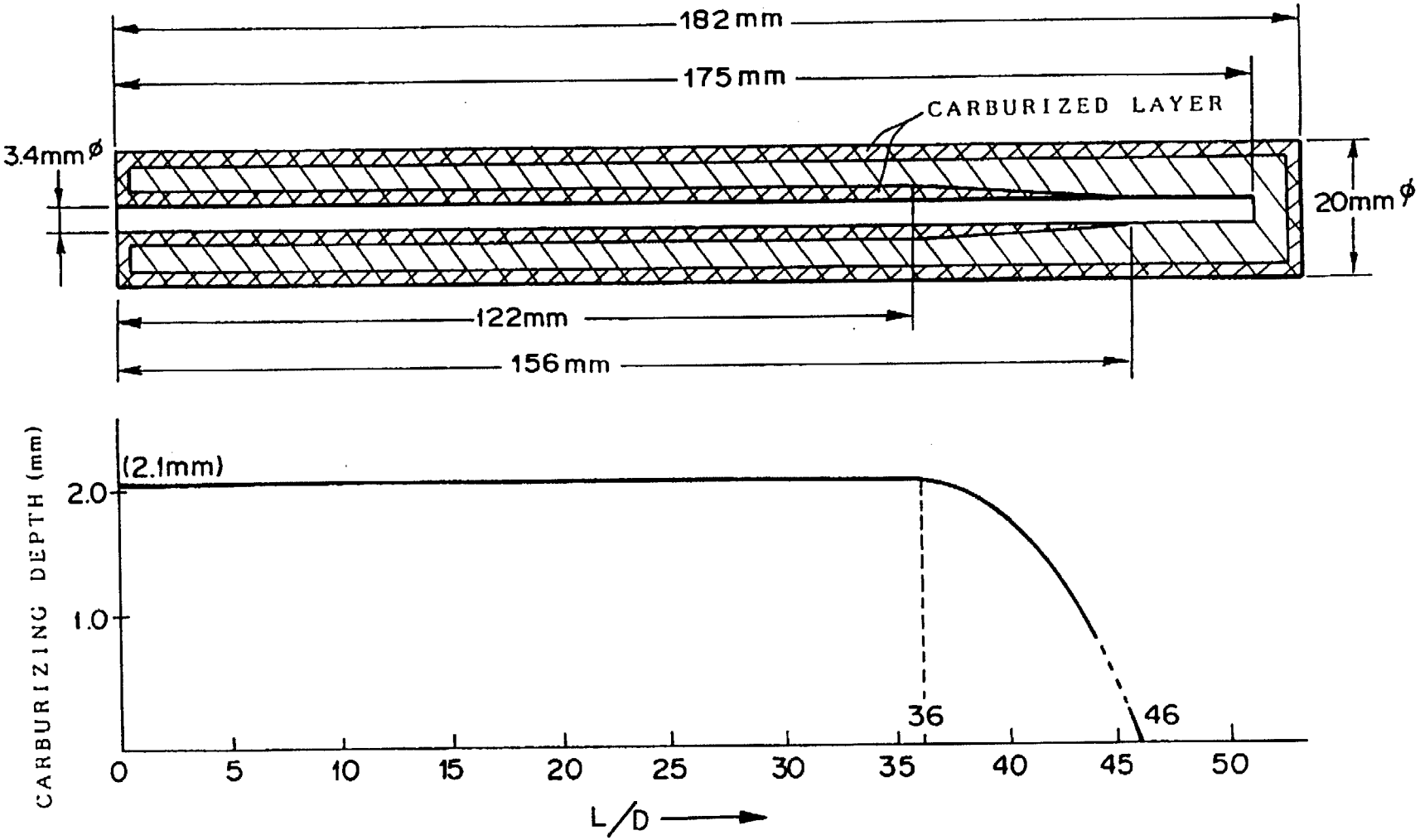
FIG. 5 is a cross-sectional diagram showing the whole of the carburized layer in a sample carburized by the vacuum carburizing method of the present invention, and a graph representing the uniformity of carburized case depth.

FIG. 5 is a cross-sectional diagram showing the state of the carburized layer formed by carrying out the carburizing method of the present invention on samples (SCM415) 20 mm in outer diameter and 182 mm long provided with closed holes 175 mm deep and 3.4 mm in inner diameter, and a graph representing the uniformity of carburizing. In this case the temperature inside the furnace was 930° C., the pressure inside the furnace 0.02 kPa and the sum of carburizing time and diffusion time was 430 minutes; the samples were loaded as described previously.

It is clear from FIG. 5 that in the inner wall of the closed holes a region of almost uniform total carburized case depth (2.1 mm) was achieved for a depth of 122 mm from the opening of the closed holes, and the total carburizing depth became zero at a depth of 156 mm. Thus, when the inner diameter of closed holes is D and the depth from the open end of the holes of a region within which total carburized case depth is almost uniform is L, the region is achieved within the range of L/D to 36. Thus, the lower the pressure inside the furnace the greater is the uniformity of carburizing, and it is possible that by lowering the pressure inside the furnace further the depth is the region L in which total carburizing is almost uniform would reach to about 50 in L/D.

What is claimed is:

1. A vacuum carburizing method which is a vacuum carburizing method in which carburizing treatment is performed by vacuum heating workpieces from steel material in the heating chamber of a vacuum carburizing furnace, and supplying a carburizing gas to the heating chamber, comprising employing a gaseous unsaturated aliphatic hydrocarbon comprising an acetylenic gas as said carburizing gas, and performing said carburizing treatment with the heating chamber at a vacuum of not more than 1 kPa.

2. A vacuum carburizing method according to claim 1, wherein said acetylenic gas comprises acetylene gas.

3. A vacuum carburizing method according to claim 1, further comprising performing a carbonitriding treatment by adding a gaseous nitrogen source to said carburizing gas.

4. A vacuum carburizing device comprising a vacuum carburizing furnace provided with a heating chamber for heating workpieces comprising steel material, a carburizing gas source which supplies an acetylenic gas into said heating chamber, and a vacuum evacuation source which evacuates said heating chamber to a pressure of not more than 1 kPa, wherein said vacuum carburizing is performed at not more than 1 kPa.

5. A carburized steel product which is a steel product provided with closed concavities in which the inside walls of said concavities are carburized having an inner diameter D and a depth L of a region over which the carburized case depth in the inner walls of the aforementioned closed holes is almost uniform characterized in that a ratio of L/D is in the range of 12–50.

6. A carburized steel product according to claim 5 wherein said ratio L/D is in the range 12–36.

7. A vacuum carburizing method which is a vacuum carburizing method in which carburizing treatment is performed by vacuum heating workpieces from steel material in the heating chamber of a vacuum carburizing furnace, and supplying a carburizing gas to the heating chamber, comprising employing a gaseous unsaturated aliphatic hydrocarbon comprising an acetylenic gas as said carburizing gas, and performing said carburizing treatment with the heating chamber at a vacuum of not more than 0.5 kPa.

8. A vacuum carburizing device comprising a vacuum carburizing furnace provided with a heating chamber for heating workpieces comprising steel material, a a carburizing gas source which supplies an acetylenic gas into said heating chamber, and a vacuum evacuation source which evacuates said heating chamber to a pressure of not more than 0.5 kPa, wherein said vacuum carburizing is performed at not more than 0.5 kPa.

* * * * *